US009054501B2

(12) United States Patent
Fujimura et al.

(10) Patent No.: US 9,054,501 B2
(45) Date of Patent: Jun. 9, 2015

(54) SPARK PLUG

(75) Inventors: Kengo Fujimura, Ichinomiya (JP); Hirokazu Kurono, Nagoya (JP); Toshitaka Honda, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 14/238,559

(22) PCT Filed: Aug. 31, 2012

(86) PCT No.: PCT/JP2012/005515

§ 371 (c)(1),
(2), (4) Date: Feb. 12, 2014

(87) PCT Pub. No.: WO2013/031232

PCT Pub. Date: Mar. 7, 2013

(65) Prior Publication Data

US 2014/0210335 A1 Jul. 31, 2014

(30) Foreign Application Priority Data

Sep. 1, 2011 (JP) ..... 2011-191085

(51) Int. Cl.
*H01T 13/20* (2006.01)
*H01T 13/34* (2006.01)

(52) U.S. Cl.
CPC ..... *H01T 13/20* (2013.01); *H01T 13/34* (2013.01)

(58) Field of Classification Search
CPC ..... H01T 13/20; H01T 13/32
USPC ..... 313/141
See application file for complete search history.

(56) References Cited

U.S. PATENT DOCUMENTS

| | | | |
|---|---|---|---|
| 4,795,944 | A | 1/1989 | Stimson |
| 2005/0110381 | A1 | 5/2005 | Kanao |
| 2006/0202599 | A1 | 9/2006 | Kato |
| 2007/0222351 | A1 | 9/2007 | Nunome |

FOREIGN PATENT DOCUMENTS

| | | | |
|---|---|---|---|
| CN | 1832280 | A | 9/2006 |
| CN | 101043124 | A | 9/2007 |

(Continued)

OTHER PUBLICATIONS

International Search Report mailed Oct. 30, 2012 for the corresponding PCT Application No. PCT/JP2012/005515.

(Continued)

*Primary Examiner* — Vip Patel
(74) *Attorney, Agent, or Firm* — Leason Ellis LLP

(57) ABSTRACT

A spark plug includes: a center electrode including a rod portion and a head portion and having a diameter larger than the diameter of the rod portion; an insulator having an axial bore, the center electrode being disposed in the axial bore at its front end; and a seal portion for fixing the center electrode in the axial bore. The insulator comprises: a leg portion inner circumferential surface; a cylindrical trunk portion inner circumferential surface which surrounds the head portion; and a support surface which supports the head portion. The seal portion has: a seal portion outer circumferential surface; a seal portion abutment surface; and a connecting surface. In a cross section of the seal portion, a curve, which is part of the contour of the seal portion and is included in the connecting surface, has a radius of curvature R of 0.1 mm or more.

5 Claims, 3 Drawing Sheets

(56) References Cited

FOREIGN PATENT DOCUMENTS

| | | | |
|---|---|---|---|
| EP | 0303353 | A | 2/1989 |
| JP | 02-165587 | A | 6/1990 |
| JP | 08-315954 | A | 11/1996 |
| JP | 2005-129377 | A | 5/2005 |
| JP | 2011-146130 | A | 7/2011 |
| WO | WO-2011/086614 | A | 7/2011 |

OTHER PUBLICATIONS

Office Action mailed Dec. 23, 2014 for the corresponding Chinese Application No. 201280036353.6.

SPARK PLUG

CROSS-REFERENCE TO RELATED PATENT APPLICATIONS

This application is a U.S. National Phase Application under 35 U.S.C. §371 of International Patent Application No. PCT/JP2012/005515, filed Aug. 31, 2012, and claims the benefit of Japanese Patent Application No. 2011-191085, filed on Sep. 1, 2011, all of which are incorporated by reference in their entirety herein. The International Application was published in Japanese on Mar. 7, 2013 as International Publication No. WO/2013/031232 under PCT Article 21(2).

FIELD OF THE INVENTION

The present invention relates to a spark plug used for ignition of an internal combustion engine, and more particularly to a spark plug having high withstand voltage.

BACKGROUND OF THE INVENTION

A spark plug used for ignition of an internal combustion engine, such as an automobile engine, generally includes: a substantially tubular metallic shell; a substantially tubular insulator disposed in a bore of the metallic shell; a center electrode disposed in an axial bore of the insulator at the front end of the axial bore; a metal terminal disposed in the axial bore at its rear end; and a ground electrode with one end joined to the front end of the metallic shell and the other end facing the center electrode so as to form a spark discharge gap. When high voltage is applied between the center electrode and the metallic shell, spark discharge occurs between the center electrode and the ground electrode, and the spark discharge causes fuel in a combustion chamber to ignite.

In recent years, with the need for increasing the output power and efficiency of internal combustion engines of automobiles etc., there is a demand for developing spark plugs reduced in size in order to, for example, reduce the size of the engines themselves and to allow the engines to be designed freely. To reduce the size of a spark plug, it is inevitable to reduce the size of the insulator. However, as the size of the insulator decreases, its thickness decreases, making it difficult to ensure the withstand voltage of the spark plug. To meet the need for increasing the output power of an engine, the discharge voltage of the spark plug tends to increase. Therefore, it is more and more difficult to ensure the withstand voltage.

An object of the invention described in Japanese Patent Application Laid-Open (kokai) No. 2005-129377 is to ensure an appropriate withstand voltage in a small-diameter spark plug having a mounting thread of M10 or less. To achieve this object, a study was conducted to find which part of a ceramic insulator is apt to be subjected to dielectric breakdown. The means for achieving the object that is described in Japanese Patent Application Laid-Open (kokai) No. 2005-129377 (claim 1) is a "spark plug characterized in that a circumferentially extending portion of the ceramic insulator (20) which has a largest diameter and is located within the metallic shell (10) forms a trunk portion (22), a portion adjacent to the trunk portion (22) and extending toward one end (20a) of the ceramic insulator (20) forms a middle portion (23) having a diameter smaller than that of the trunk portion (22), the trunk portion (22) and the middle portion (23) of the ceramic insulator (20) face the inner surface of the metallic shell (10) through a gap, and (D1−D2)/2 is 1.8 mm or less, wherein D1 is the inner diameter of a portion of the metallic shell (10) facing the trunk portion (22) through the gap, and D2 is the inner diameter of a portion of the metallic shell (10) facing the middle portion (23) through the gap." However, in recent years, the thickness of ceramic insulators tends to decrease more and more, and therefore there is demand for a spark plug with further improved withstand voltage.

SUMMARY OF THE INVENTION

Problems to be Solved by the Invention

An object of the present invention is to provide a spark plug with high withstand voltage.

Means for Solving the Problems

Means for solving the problems is:

(1) a spark plug comprising:

a center electrode including a rod portion extending in a direction of an axis and a head portion extending continuously from a rear end of the rod portion and having a diameter larger than a diameter of the rod portion;

an insulator having an axial bore, the center electrode being disposed in the axial bore at a front end thereof; and a seal portion for fixing the center electrode in the axial bore;

the spark plug being characterized in that the insulator has a leg portion inner circumferential surface which surrounds the rod portion, a cylindrical trunk portion inner circumferential surface which has a diameter larger than a diameter of the leg portion inner circumferential surface, surrounds the head portion, and has a center axis coinciding with the axis, and a support surface which supports the head portion and extends continuously between the leg portion inner circumferential surface and the trunk portion inner circumferential surface, the seal portion has a seal portion outer circumferential surface in contact with the trunk portion inner circumferential surface, a seal portion abutment surface in contact with the support surface, and a connecting surface extending continuously between the seal portion outer circumferential surface and the seal portion abutment surface, and, in a cross section of the seal portion cut along a plane including the axis, a curve which is part of a contour of the seal portion appearing in the cross-section and is included in the connecting surface has a radius of curvature R of 0.1 mm or more.

Preferred modes of the spark plug mentioned above in (1) are enumerated below.

(2) When a diameter d of the axial bore is 3 mm or less at a position at which the diameter of the head portion becomes maximum within a region surrounded by the trunk portion inner circumferential surface, the radius of curvature R is 0.6 mm or less.

(3) In the spark plug according to (1) or (2) mentioned above, the insulator has an insulator connecting surface extending continuously between the support surface and the leg portion inner circumferential surface, and, in a cross section of the insulator cut along a plane including the axis, a curve which is part of a contour of the insulator appearing in the cross-section and is included in the insulator connecting surface has a radius of curvature r of 0.6 mm or less.

(4) In the spark plug according to (2) mentioned above, the diameter d is 2.7 mm or less.

Effects of the Invention

In the spark plug of the present invention, the radius of curvature R is 0.1 mm or more. This can prevent the occurrence of dielectric breakdown caused by electric field concentration on the seal portion and leading to leakage of current between the center electrode and the metallic shell through the insulator (such leakage may be hereinafter referred to as "through discharge"). Therefore, according to the present invention, the occurrence of through discharge can be prevented, and a spark plug having high withstand voltage can thereby be provided.

In the spark plug of the present invention, when a diameter d of the axial bore is 3 mm or less, particularly 2.7 mm or less, at a position at which the diameter of the head portion becomes maximum within a region surrounded by the trunk portion inner circumferential surface, the radius of curvature R is 0.6 mm or less. Therefore, the amount of the seal material forming the seal portion in which the center electrode is embedded can be ensured, so that the seal portion can be prevented from being separated from the center electrode. When the seal portion is separated from the center electrode, an edge is likely to be formed at a portion of the seal portion that is in contact with the inner circumferential surface of the insulator, so that electric field concentration is likely to occur at the edge. However, in the spark plug of the present invention, separation of the seal portion from the center electrode can be prevented. Therefore, an edge is unlikely to be formed in the seal portion, and occurrence of through discharge caused by electric field concentration on the edge can be prevented. According to the present invention, a spark plug with much higher withstand voltage properties can be provided.

In the spark plug of the present invention, since the radius of curvature r of the insulator is 0.6 mm or less, a sufficient area of contact between the insulator and the center electrode can be obtained, so that rattling of the center electrode in the axial bore can be suppressed. Therefore, separation of the seal portion from the center electrode can be prevented. Accordingly, as described above, the occurrence of through discharge can be prevented, and a spark plug with much higher withstand voltage can be provided.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
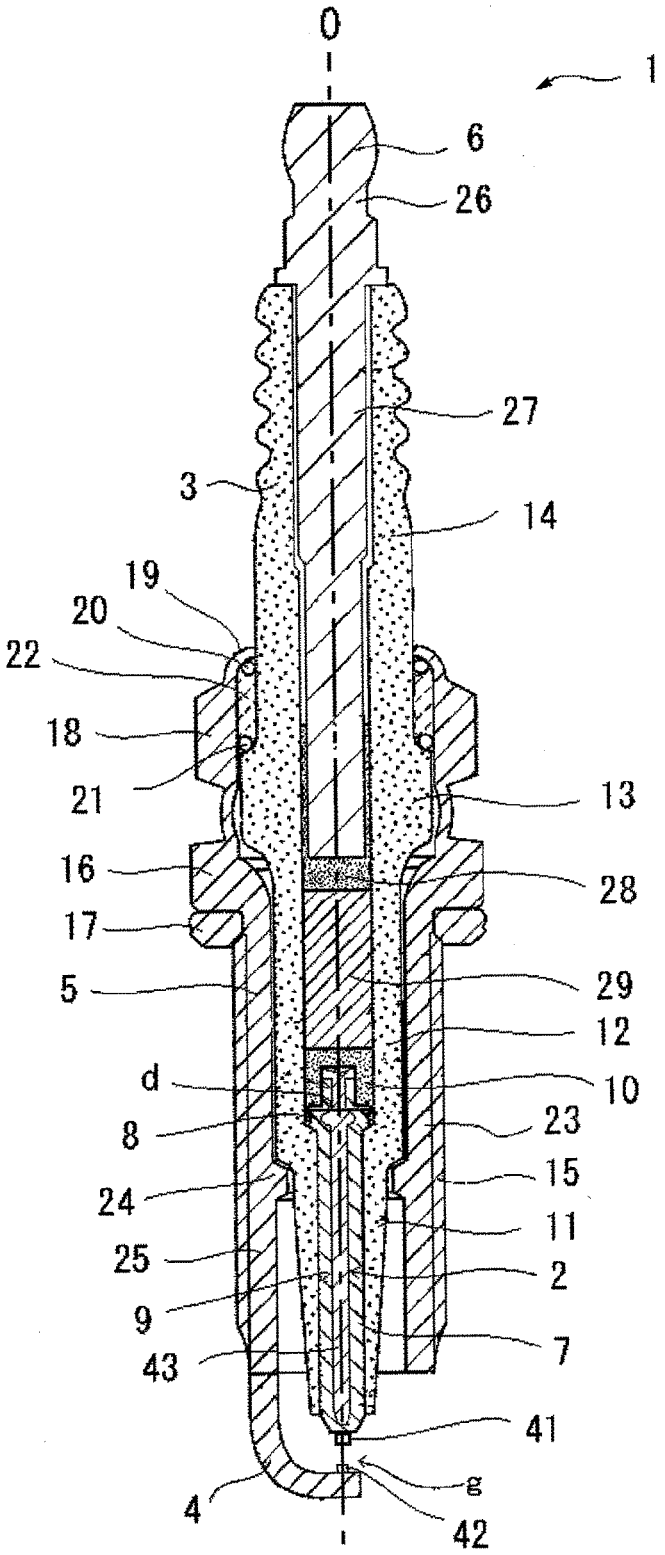
FIG. 1 is a general cross-sectional view of a spark plug which is one example of the spark plug of the present invention.

FIG. 1 shows a spark plug which is one embodiment of the spark plug according to the present invention. FIG. 1 is a general cross-sectional view of the spark plug 1 which is one embodiment of the spark plug according to the present invention. First, the configuration of the spark plug will be briefly described with reference to FIG. 1. In the following description, the axis of a center electrode is denoted by O. In FIG. 1, a downward direction on the sheet is referred to as a forward direction along the axis O, and an upward direction on the sheet is referred to as a rearward direction along the axis O.

As shown in FIG. 1, the spark plug 1 includes a center electrode 2 having a rod portion 7 extending in the direction of the axis O and a head portion 8 extending continuously from the rear end of the rod portion 7 and having a diameter larger than that of the rod portion 7; an insulator 3 having an axial bore 9, with the center electrode 2 disposed in the axial bore 9 at its front end and a metal terminal 6 disposed in the axial bore 9 at its rear end; a seal portion 10 for fixing the center electrode 2 in the axial bore 9; a substantially tubular metallic shell 5 disposed around the insulator 3; and a ground electrode 4 with one end joined to the front end of the metallic shell 5 and the other end disposed to face the center electrode 2 through a gap.

The center electrode 2 has the rod portion 7 extending in the direction of the axis O and the head portion 8 extending continuously from the rear end of the rod portion 7 and having a diameter larger than that of the rod portion 7. The center electrode 2 is held in the axial bore 9 on its forward side so as to be insulated from the metallic shell 5, with the front end of the center electrode 2 protruding from the front end surface of the insulator 3. Preferably, the center electrode 2 is formed from a material having thermal conductivity, mechanical strength, etc. For example, the center electrode 2 is formed from a Ni-based alloy such as Inconel (trademark). An inner member 43 formed from a material which is high in thermal conductivity such as a Cu alloy may be provided at the center of the center electrode 2.

The substantially cylindrical insulator 3 having the axial bore 9 includes, in the following order from the forward side in the direction of the axis O, a leg portion 11 defining a portion of the axial bore 9 in which the rod portion 7 is accommodated; a trunk portion 12 having an inner diameter larger than that of the leg portion 11 and defining a portion of the axial bore 9 in which the head portion 8 is accommodated; a collar-shaped flange portion 13 protruding radially outward; and a rear trunk portion 14 defining a portion of the axial bore 9 in which the metal terminal 6 is accommodated. Preferably, the insulator 3 is formed from a material having mechanical strength, thermal strength, electric strength, etc. For example, the insulator 3 is formed from a ceramic sintered body formed mainly of alumina.

The metallic shell 5 has a substantially tubular shape and is formed so as to accommodate and hold the insulator 3. A threaded portion 15 is formed on the outer circumferential surface of a forward end portion of the metallic shell 5, and the spark plug is attached to the cylinder head of an internal combustion engine (not shown) through the threaded portion 15. Preferably, for the purpose of reducing the diameter of the spark plug, the threaded portion 15 has a size of M12 or less. A flange-shaped gas seal portion 16 is formed rearward of the threaded portion 15, and a gasket 17 is fitted between the gas seal portion 16 and the threaded portion 15. A tool engagement portion 18 for engagement with a tool such as a spanner or a wrench is formed rearward of the gas seal portion 16, and a crimp portion 19 is formed rearward of the tool engagement portion 18. Ring-shaped packings 20 and 21 and talc 22 are disposed in an annular space formed between the outer circumferential surface of the insulator 3 and the inner circumferential surfaces of the crimp portion 19 and the tool engagement portion 18, and the insulator 3 is thereby fixed to the metallic shell 5. A tubular portion 23 surrounding the trunk portion 12 of the insulator 3 is formed forward of the gas seal portion 16, and a ledge portion 24 protruding radially inward is formed forward of the tubular portion 23. A front tubular portion 25 surrounding the leg portion 11 of the insulator 3 is formed forward of the ledge portion 24. The metallic shell 5 is formed from a steel material having electrical conductivity such as low-carbon steel.

The structure and shape of the ground electrode 4 are designed as follows. For example, the ground electrode 4 is formed to have a substantially prism shape. The ground electrode 4 is joined at one end to the front end surface of the metallic shell 5 and bent at an intermediate portion into a substantially L-shape such that the distal end portion of the ground electrode 4 faces the front end portion of the center electrode 2 with a gap g formed therebetween. The ground electrode 4 is formed from a material similar to that used to form the center electrode 2.

The metal terminal 6 is used to externally apply to the center electrode 2 a voltage for generating spark discharge between the center electrode 2 and the ground electrode 4. The metal terminal 6 includes an exposed portion 26 and a substantially cylindrical columnar portion 27. The exposed portion 26 has an outer diameter larger than the inner diameter of the axial bore 9, and protrudes from the axial bore 9. The exposed portion 26 has a flange-shaped portion partially in contact with an end surface of the insulator 3 located on the rear side with respect to the direction of the axis O. The cylindrical columnar portion 27 extends forward from an end surface of the exposed portion 26 located on the front side with respect to the direction of the axis O. The cylindrical columnar portion 27 is accommodated in the axial bore 9. The metal terminal 6 is formed from, for example, low-carbon steel.

The head portion 8 of the center electrode 2 is embedded in the seal portion 10, so that the center electrode 2 is fixed within the axial bore 9. The seal portion 10 may be formed from a seal material formed by sintering a seal powder containing base glass, an electrically conductive filler, and an insulating filler. The base glass is composed mainly of an oxide glass and is, for example, a borosilicate-base glass. The electrically conductive filler is a metal powder composed mainly of one or more of metal components such as Cu and Fe. The insulating filler is an oxide-based inorganic material composed of one or more species selected from β-eucryptite, β-spodumene, keatite, silica, mullite, cordierite, zircon, and aluminum titanate. The resistance of the seal portion 10 formed of the above seal material is generally 0.1 mΩ to several hundreds of mΩ and is, for example, 900 mΩ.

The seal material may be disposed such that a portion of the metal terminal 6 near its front end is embedded in the seal material. In the embodiment shown in FIG. 1, a seal material in which the center electrode 2 is embedded and a seal material in which the metal terminal 6 is embedded are used. Therefore, to distinguish these materials from each other, the former may be referred to as a lower seal portion 10, and the latter may be referred to as an upper seal portion 28.

For the purpose of reducing propagation noise, a resistor 29 is disposed in the axial bore 9 between the metal terminal 6 and the center electrode 2. The resistor 29 may be formed, for example, from a resistive material prepared by sintering a resistor composition containing powder of a glass such as sodium borosilicate glass, powder of a ceramic such as $ZrO_2$, powder of a non-metal conductive material such as carbon black, and/or powder of a metal such as Zn, Sb, Sn, Ag, or Ni. The resistance of the resistor 29 formed from the above resistive material is generally 100Ω or higher. The resistive material 29 is disposed as needed, and the entire space between the center electrode 2 and the metal terminal 6 may be filled with the seal material.

The seal material contains a larger amount of metal component than does the resistive material. Therefore, the lower seal portion 10 disposed between the resistor 29 and the center electrode 2 increases the bonding strength therebetween. The upper seal portion 28 disposed between the resistor 29 and the metal terminal 6 increases the bonding strength therebetween. It is therefore preferable to dispose the lower seal portion 10 between the resistor 29 and the center electrode 2 and to dispose the upper seal portion 28 between the resistor 29 and the metal terminal 6. However, the upper seal portion 28 may be formed from the resistive material to fix the metal terminal 6 within the axial bore 9.

Noble metal tips 41 and 42 formed from, for example, a platinum alloy or an iridium alloy may be disposed on the center electrode 2 and the ground electrode 4, specifically on their surfaces facing each other. A noble metal tip may be disposed on only one of the center electrode 2 and the ground electrode 4. In the spark plug 1 in this embodiment, the noble metal tips 41 and 42 are disposed on the center electrode 2 and the ground electrode 4, and the spark discharge gap g is formed between the noble metal tips 41 and 42.

Figure 2:
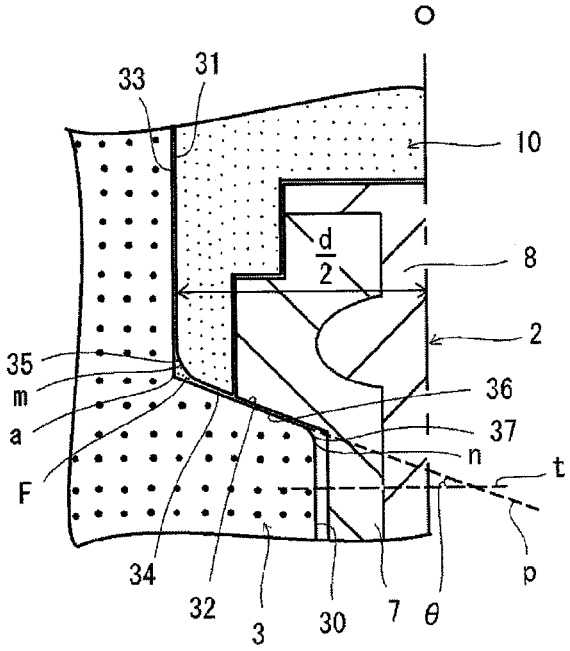
FIG. 2 is an enlarged cross-sectional view illustrating a main part of the spark plug in FIG. 1, showing the vicinity of the head portion of a center electrode in the spark plug.

Next, a characteristic portion of the spark plug of the present invention will be described with reference to FIG. 2. FIG. 2 is an enlarged cross-sectional view of a main portion of the park plug of FIG. 1, which shows the head portion 8 of the center electrode and its surrounding.

The insulator 3 includes a leg portion inner circumferential surface 30 surrounding the rod portion 7; a substantially tubular trunk portion inner circumferential surface 31 that has a diameter larger than the diameter of the leg portion inner circumferential surface 30, surrounds the head portion 8, and has a center axis substantially coinciding with the axis O; and a support surface 32 that supports the head portion 8 and extends continuously between the leg portion inner circumferential surface 30 and the trunk portion inner circumferential surface 31. The support surface 32 is a portion disposed between the leg portion inner circumferential surface 30 and the trunk portion inner circumferential surface 31 so as to continuously connect the leg portion inner circumferential surface 30 to the trunk portion inner circumferential surface 31. The seal portion 10 includes a seal portion outer circumferential surface 33 in contact with the trunk portion inner circumferential surface 31; a seal portion abutment surface 34 in contact with the support surface 32; and a connecting surface 35 extending continuously between the seal portion outer circumferential surface 33 and the seal portion abutment surface 34. The connecting surface 35 is a portion disposed between the seal portion outer circumferential surface 33 and the seal portion abutment surface 34 so as to continuously connect the seal portion outer circumferential surface 33 to the seal portion abutment surface 34. When the spark plug 1 is manufactured, the insulator 3, the center electrode 2, etc. are formed to be axisymmetric, and are usually assembled such that the axis O coincides with the center axis of the trunk portion inner circumferential surface 31. However, the insulator 3, the center electrode 2, etc. have production tolerances, assembly errors, etc. Therefore, the phrase "the axis O coincides with the center axis of the trunk portion inner circumferential surface 31" means that they coincide with each other within the range of the above errors etc.

Figure 3:
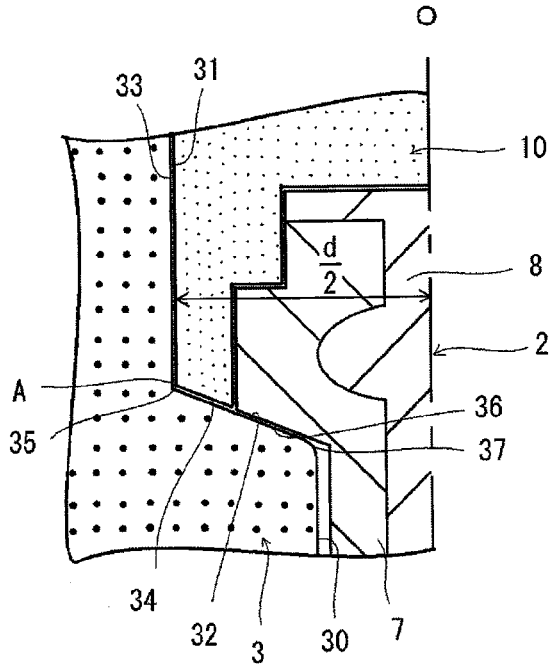
FIG. 3 is an enlarged cross-sectional view illustrating a main part of a spark plug in another embodiment, showing the vicinity of the head portion of a center electrode in the spark plug.

As shown in FIG. 2 that illustrates the spark plug of the present invention cut along a plane including the axis O, curve m, which is part of the contour of the seal portion 10 appearing in the cross-section and is included in the connecting surface 35, has a radius of curvature R of 0.1 mm or more. If the radius of curvature R is less than 0.1 mm, the connecting surface 35 is no longer a smooth curved surface, and an edge A is formed (see FIG. 3). In this case, electric field concentration is likely to occur at the edge A. Therefore, dielectric breakdown of the insulator 3 may occur in the vicinity of a portion in contact with the edge A, leading to the occurrence of through discharge between the center electrode 2 and the metallic shell 5. However, when the radius of curvature R is 0.1 mm or more, electric field concentration is unlikely to occur, so that through discharge is unlikely to occur in the insulator 3. Accordingly, a spark plug having high withstand voltage can be provided. As the thickness of the insulator 3 decreases, through discharge is more likely to occur. Therefore, when the thickness of the insulator 3 at a position at which the diameter of the head portion 8 is maximum is 2.3 mm or less, the effect obtained by setting the radius of curvature R to 0.1 mm or more becomes particularly significant.

Since the seal portion outer circumferential surface 33 is in contact with the cylindrical trunk portion inner circumferential surface 31, the seal portion outer circumferential surface 33 also has a cylindrical shape. Since the seal portion abutment surface 34 is in contact with the entire support surface 32 or part of the support surface 32, the seal portion abutment surface 34 has the same shape as the shape of the support surface 32 or the same shape as the shape of part of the support surface 32. For example, the support surface 32 shown in FIG. 2 is tapered such that it expands toward its rear end along the axis O, and the seal portion abutment surface 34 is in contact with part of the support surface 32, so that the seal portion abutment surface 34 has a tapered shape having an area smaller than the area of the support surface 32. The connecting surface 35 is disposed continuously between the seal portion outer circumferential surface 33 and the seal portion abutment surface 34 and is formed such that the seal portion outer circumferential surface 33, the connecting surface 35, and the seal portion abutment surface 34 form a single continuous surface. The connecting surface 35 is a curved surface convex toward the forward side in the direction of the axis O.

Figure 4:
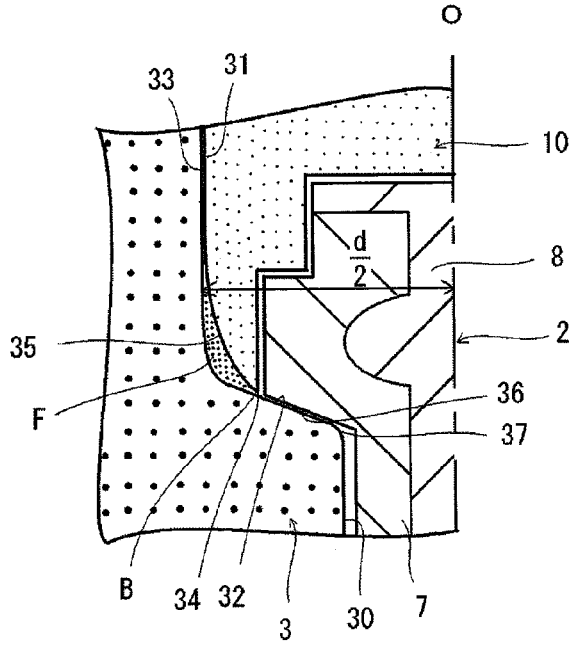
FIG. 4 is an enlarged cross-sectional view illustrating a main part of a spark plug in another embodiment, showing the vicinity of the head portion of a center electrode in the spark plug.

When the diameter d of the axial bore 9 is 3 mm or less at a position at which the diameter of the head portion 8 becomes maximum within a region surrounded by the trunk portion inner circumferential surface 31, the radius of curvature R is preferably 0.6 mm or less. The smaller the diameter d, the greater the difficulty in ensuring the space for disposing the seal material between the insulator 3 and the head portion 8. When the space for disposing the seal material is narrow, if the radius of curvature R is large, the amount of the disposed seal material becomes small as shown in FIG. 4. In this case, the adhesion of the seal material to the head portion 8 may decrease. If the adhesion decreases, the seal portion 10 is separated from the head portion 8, and a gap is formed, so that the seal portion 10 has an edge B. If such an edge B is present, electric field concentration may occur near the edge B, causing through discharge to occur in the insulator 3. However, when the radius of curvature R is 0.6 mm or less, the space to be filled with the seal material can be ensured, so that the separation of the seal portion 10 from the head portion 8 is prevented. Therefore, through discharge is less likely to occur in the insulator 3, and a spark plug having high withstand voltage can be provided.

When the diameter d is 2.7 mm or less, the radius of curvature R is more preferably 0.6 mm or less. During a process of producing the seal portion 10, which will be described later, pressing pressure is applied to the seal powder when the seal powder is charged into the axial bore 9, and pressing pressure is also applied to the seal powder during hot press fitting. As the diameter d decreases, such pressing pressures are transmitted more easily, so that the seal material is charged up to the front end of the space for disposing the seal material. In this case, when the seal portion 10 is separated from the head portion 8, a sharper edge B is formed. The sharper the edge B, the more likely the concentration of electric field is to occur near the edge B. Therefore, when the diameter d is 2.7 mm or less, the radius of curvature R is set to be 0.6 mm or less. Thus, the occurrence of separation of the seal portion 10 from the head portion 8 can thereby be suppressed, and the formation of a sharp edge B is suppressed. In this case, the effect obtained by setting the radius of curvature R to be 0.6 mm or less becomes more remarkable.

One possible way to ensure the space to be filled with the seal material is to reduce the diameter of the head portion 8 as the diameter d of the insulator decreases. However, for example, if the diameter of the head portion 8 is reduced with the thickness of the rod portion 7 unchanged, the difference in diameter between the head portion 8 and the rod portion 7 becomes small, so that the area of an abutment surface 36 supported by the support surface 32 decreases. In this case, it is difficult to fix the center electrode 2 within the axial bore 9 in a reliable manner. If both the diameter of the head portion 8 and the diameter of the rod portion 7 are reduced, the volume of the center electrode 2 becomes small, so that heat generated by spark discharge and heat received from a combustion chamber are not easily dissipated (this heat dissipation may be hereinafter referred to as heat transfer). In this case, the seal material may deteriorate, so that the adhesion of the seal material may be reduced. When the diameter d is 3 mm or less, particularly 2.7 mm or less, the diameter of the head portion 8 and the diameter of the rod portion 7 are set in consideration of fixation of the center electrode within the axial bore, the heat transfer effect, etc. Therefore, the radius of curvature R is preferably set to 0.6 mm or less in order to ensure a sufficient amount of the seal material disposed in the space for the seal material.

As shown in FIG. 2, the insulator 3 includes an insulator connecting surface 37 extending continuously between the support surface 32 and the leg portion inner circumferential surface 30. The insulator connecting surface 37 is a portion disposed between the support surface 32 and the leg portion inner circumferential surface 30 so as to continuously connect the support surface 32 to the leg portion inner circumferential surface 30. In a cross section of the insulator 3 cut along a plane including the axis O, curve n, which is part of the contour of the insulator 3 appearing in the cross-section and is included in the insulator connecting surface 37, preferably has a radius of curvature r of preferably 0.1 mm or more and 0.6 mm or less. As the radius of curvature r increases, the area of contact between the support surface 32 of the insulator 3 and the abutment surface 36 of the center electrode 2 decreases, so that the center electrode 2 is not firmly fixed within the axial bore 9. In this case, vibration etc. that occur during operation of the engine cause rattling of the center electrode 2 in the axial bore 9, so that the seal portion 10 is likely to be separated from the head portion 8. However, when the radius of curvature r is 0.6 mm or less, the area of contact between the insulator 3 and the center electrode 2 is ensured. In this case, rattling of the center electrode 2 in the axial bore 9 is prevented, and separation of the seal material from the head portion 8 can be prevented. Therefore, the occurrence of through discharge caused by electric field concentration on an edge formed on the seal portion 10 can be prevented more effectively. If the radius of curvature r is less than 0.1 mm, the insulator connecting surface 37 is likely to chip when the center electrode 2 is inserted into the insulator 3 during the process of producing the spark plug. When the insulator connecting surface 37 chips, the area of contact between the support surface 32 of the insulator 3 and the abutment surface 36 of the center electrode 2 decreases. In this case, rattling of the center electrode 2 may occur in the axial bore 9, and this may lead to further chipping of the insulator 3. However, when the radius of curvature r is 0.1 mm or more, rattling of the center electrode 2 in the axial bore 9 is prevented, so that separation of the seal portion 10 from the head portion 8 can be prevented. Therefore, the occurrence of through discharge caused by electric field concentration on an edge formed on the seal portion 10 can be prevented more effectively.

Figure 5:
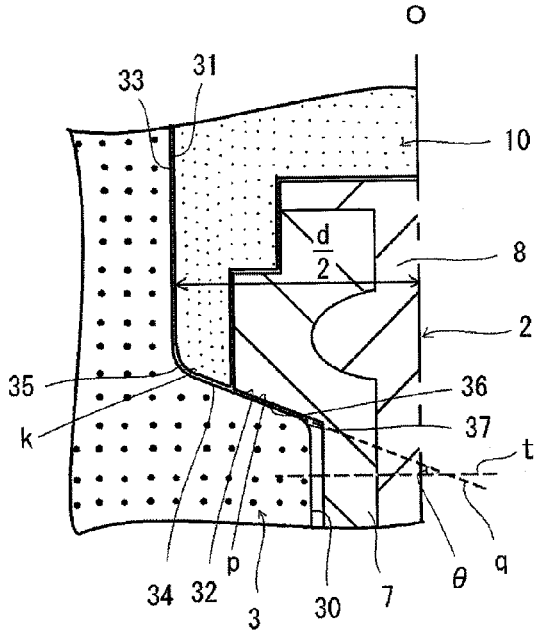
FIG. 5 is an enlarged cross-sectional view illustrating a main part of a spark plug in another embodiment, showing the vicinity of the head portion of a center electrode in the spark plug.

As shown in FIG. 2, in the cross section of the insulator 3 cut along a plane including the axis O, the angle θ formed between straight line t orthogonal to the axis O and line p which is part of the contour of the insulator 3 appearing in the cross-section and is included in the support surface 32 is preferably 10° or more and 60° or less. If the angle θ is larger than 60°, the area of contact between the seal portion 10 and the head portion 8 decreases, so that the adhesion therebetween may decrease. However, when the angle θ is 60° or less, separation of the seal portion 10 from the head portion 8 is prevented, so that the occurrence of through discharge caused by electric field concentration on an edge B formed on the seal portion 10 can be prevented more effectively. If the angle θ is less than 10°, the load applied to the support surface 32 when the metal terminal 6 is inserted into the axial bore 9 for sealing and fixing may not be dispersed, so that the support surface 32 may be cracked. However, when the angle θ is 10° or more, the probability of the occurrence of cracking of the support surface 32 can be reduced, so that the rate of occurrence of defective products can be reduced. The line p is a straight line in the spark plug shown in FIG. 2. When part of the line p is curved as shown in FIG. 5, a tangential line of the support surface 32 in contact with the abutment surface 36 at a point on the line p is defined as line q, and the angle formed between the line q and the straight line t is used as θ.

In the spark plug of the present invention, no particular limitation is imposed on the shapes of the trunk portion inner circumferential surface 31 and support surface 32 of the insulator 3, so long as the radius of curvature R is 0.1 mm or more. For example, instead of forming a curved surface which smoothly connects the trunk portion inner circumferential surface 31 and the support surface 32, a (unrounded) corner "a" may be formed between the trunk portion inner circumferential surface 31 and the support surface 32 as shown in FIG. 2. In this case, a region in which the support surface 32 and the connecting surface 35 are not in contact with each other is present, and a space F surrounded by the trunk portion inner circumferential surface 31, the support surface 32, the seal portion outer circumferential surface 33, the connecting surface 35, and the seal portion abutment surface 34 is formed. As shown in FIG. 5, the support surface 32 may extend along a curved surface formed by the seal portion abutment surface 34 and the connecting surface 35. In this case, the support surface 32 is formed so as to be in contact with the seal portion abutment surface 34 and the connecting surface 35, and the space F is not formed. Although not illustrated, the support surface 32 may form a curved surface such that a region in which the support surface 32 and the connecting surface 35 are not in contact with each other is present. In this case, a space F is formed. When the space F is formed, it is preferable that an insulating material having a relative dielectric constant of 3 or more and 10 or less is present in the space F. The relative dielectric constant of the seal material is typically 1 or less, and the relative dielectric constant of the insulator 3 is typically 4 to 11. When an insulating material having a relative dielectric constant higher than the relative dielectric constant of the seal material and comparable to or lower than the relative dielectric constant of the insulator is present in the space F, the portion including the above insulating material serves as an insulating material, as does the insulator 3. Therefore, even when the insulator has the corner "a" as shown in FIG. 2, electric field concentration is unlikely to occur at the edge, and through discharge caused by electric field concentration is unlikely to occur in the insulator 3.

Examples of the insulating material having a relative dielectric constant of 3 or more and 10 or less include inorganic compounds such as glass, cement, alumina, silica, and barium titanate. The relative dielectric constant of a composition formed of a plurality of such inorganic compounds can be controlled by controlling the amounts of these inorganic compounds.

The dimensions of the above-described spark plug can be measured using a projector, a micrometer, and pin gauges. The radius of curvature R and the radius of curvature r can be measured using, for example, a DIGITAL MICROSCOPE VHX-200 (manufactured by KEYENCE).

An example of the method of producing the spark plug of the present invention will next be described.

Each of the center electrode 2 and the ground electrode 4 can be produced as follows. First, a molten alloy having a desired composition is prepared using, for example, a vacuum melting furnace, and an ingot is prepared using the molten alloy by vacuum casting. Then, the ingot is subjected to, for example, plastic working to adjust its shape and dimensions appropriately, whereby the center electrode 2 or the ground electrode 4 with prescribed shape and prescribed dimensions is produced. The center electrode 2 may be formed by inserting an inner member formed of, for example, a Cu alloy into a cup-shaped outer member formed of, for example, a Ni alloy and then subjecting the obtained product to plastic working such as extrusion.

Next, one end of the ground electrode 4 is joined, by electric resistance welding, laser welding, etc., to the front end surface of the metallic shell 5 formed into a prescribed shape by, for example, plastic working.

Next, if necessary, a molten material obtained by melting a tip material having a desired composition is formed into a plate, and the plate is subjected to hot punching to produce noble metal tips punched into a prescribed tip shape. The noble metal tips 41 and 42 are fusion-bonded to the center electrode 2 and the ground electrode 4 by, for example, electric resistance welding and/or laser welding.

Separately, a ceramic-made insulator 3 is produced such that its shape and dimensions are appropriately adjusted to a prescribed shape and prescribed dimensions.

A process of producing the seal portion 10 will be described for the case where, as shown in FIG. 2, the seal portion 10 is in contact with part of the support surface 32 tapered such that it expands toward the rear end thereof. First, the center electrode 2 with the noble metal tip 41 joined thereto is inserted into the axial bore 9 of the insulator 3. Next, an insulating material different from the seal powder for forming the seal portion 10 is charged such that the corner "a" formed by the support surface 32 and the trunk portion inner circumferential surface 31 is filled with the insulating material to thereby form a curved surface. The relative dielectric constant of the insulating material is preferably 3 or more and 10 or less. Then the seal powder for forming the seal portion 10 is charged such that the head portion 8 is embedded in the seal powder, and the resistor composition for forming the resistor 29 is charged so as to be placed rearward of the seal powder. Then the seal powder is charged so as to be placed rearward of the resistor composition, and the powders are pre-compressed. Next, the metal terminal 6 is inserted into the axial bore 9 from one end thereof so as to hot-press the resistor composition and the seal powder. The resistor composition is thereby sintered, and the resistor 29 is formed. In addition, the seal powder is sintered, and the lower seal portion 10 and the upper seal portion 28 are thereby formed. With the above production method, it is unnecessary to produce the insulator 3 such that the support surface 32 and the trunk portion inner circumferential surface 31 form a continuous smooth curved surface. In this production method, after the insulator 3 having the corner "a" is formed, the insulating material is charged so as to fill the corner "a," whereby the surface on the insulator 3 that faces the connecting surface 35 of the seal portion 10 can be formed as a curved surface. The use of the insulating material allows easy adjustment of the radius of curvature of the contour line of the insulator 3 that faces the connecting surface 35 and appears in the cross-section obtained by cutting the insulator 3 along a plane containing the axis O. Accordingly, a seal portion 10 having the desired radius of curvature R can be easily produced only by charging the seal powder into the axial bore 9 with the corner "a" filled with the insulating material.

The method of producing the seal portion 10 with a radius of curvature R of 0.1 mm or more is not limited to the above-described method. For example, when the support surface 32 is in contact with the entire seal portion abutment surface 34 and the entire connecting surface 35 as shown in FIG. 5, the seal portion 10 can be produced as follows. Specifically, the insulator 3 is formed such that, in a cross section of the insulator 3 cut along a plane including the axis O, the radius of curvature $R_2$ of curve k, which is part of the contour of the insulator 3 appearing in the cross-section and is included in the support surface 32 near its boundary with the trunk portion inner circumferential surface 31, is 0.1 mm or more. The center electrode 2 with the noble metal tip 41 joined thereto is inserted into the axial bore 9 of the insulator 3. Then the seal powder is charged such that the head portion 8 is embedded therein, and the resistor composition for forming the resistor 29 is charged so as to be placed rearward of the seal powder. The seal powder is charged so as to be placed rearward of the resistor composition, and the powders are pre-compressed. The steps subsequent thereto are performed in the same manner as described above, whereby the seal portion 10 with a radius of curvature R of 0.1 mm or more can be produced.

Finally, the insulator 3 with the center electrode 2 etc. fixed thereto is installed into the metallic shell 5 with the ground electrode 4 joined thereto. The distal end portion of the ground electrode 4 is bent toward the center electrode 2 such that a gap g is formed between one end of the ground electrode 4 and the front end of the center electrode 2, whereby the spark plug 1 is produced.

The spark plug according to the present invention is used for an internal combustion engine, e.g., a gasoline engine, of an automobile. The threaded portion 15 is screwed into a thread hole provided in a head (not shown) that forms a sectioned combustion chamber of the internal combustion engine, and the spark plug is thereby fixed to a prescribed position.

The spark plug according to the present invention is not limited to the above-described embodiments, and various modifications may be made, so long as the object of the present invention can be achieved.

EXAMPLES

Production of Spark Plugs "a"

According to the production process described above, a plurality of spark plugs "a" with the support surface in contact with the entire seal portion abutment surface and the entire connecting surface as shown in FIG. 5 were produced. The spark plugs "a" produced had different diameters d and different radii of curvature R. The thickness of the insulator at the position at which the diameter d was measured was 1.7 (mm), the maximum diameter of the head portion was 3.5 (mm), the diameter of the rod portion was 2.3 (mm), θ was 30 (°), and the radius of curvature r was 0.6 (mm).

Production of Spark Plugs "b"

According to the production process described above, a plurality of spark plugs "b" with the support surface in contact with the entire seal portion abutment surface and the entire connecting surface as shown in FIG. 5 were produced. The spark plugs "b" produced had different diameters d and different radii of curvature r. The radius of curvature R was 0.3 (mm), the thickness of the insulator at the position at which the diameter d was measured was 1.7 (mm), the maximum diameter of the head portion was 3.5 (mm), the diameter of the rod portion was 2.3 (mm), and θ was 30 (°).

Production of Spark Plugs "c"

According to the production process described above, a plurality of spark plugs "c" in which the support surface was tapered to expand toward its rear end and the seal portion was in contact with part of the support surface as shown in FIG. 2 were produced. The radius of curvature R was 0.3 (mm), the diameter d was 3.9 (mm), the thickness of the insulator at the position at which the diameter d was measured was 1.7 (mm), the maximum diameter of the head portion was 3.5 (mm), the diameter of the rod portion was 2.3 (mm), and θ was 30 (°).

The above dimensions were measured using a projector, a micrometer, and pin gauges, and the radius of curvature R and the radius of curvature r were measured using a DIGITAL MICROSCOPE VHX-200 (manufactured by KEYENCE).

1. Evaluation of Withstand Voltage Properties Using Seal Portions with Different Radii of Curvature R (Withstand Voltage Test)

A withstand voltage test was performed using the above spark plugs "a" according to the "withstand voltage test" described in section 7.3 of JIS B 8031 (2006). In the test, a voltage of 35 kV was applied. The occurrence of discharge through the insulator was examined, and evaluation was made according to the following criteria.

C: The number of spark plugs in which discharge through the insulator occurred out of 20 spark plugs was 11 to 20.

B: The number of spark plugs in which discharge through the insulator occurred out of 20 spark plugs was 3 to 10.

A: The number of spark plugs in which discharge through the insulator occurred out of 20 spark plugs was 0 to 2.

The results of the withstand voltage test performed using different diameters d and different radii of curvature R are shown in TABLE 1.

TABLE 1

| Diameter d (mm) | Radius of curvature R (mm) 0 | 0.05 | 0.1 | 0.3 | 0.6 |
|---|---|---|---|---|---|
| 3.9 | C | C | B | A | A |
| 3.0 | C | C | A | A | A |
| 2.9 | C | C | A | A | A |

(Withstand Voltage Test after Vibration Test)

The withstand voltage test was performed after a vibration test. Specifically, impact was applied to the spark plugs "a" for 10 minutes with a stroke of 22 (mm) at a rate of 400 times per minute according to the "impact resistance test" described in section 7.4 of JIS B 8031 (2006), and then the withstand voltage test was performed.

The results of the withstand voltage test performed using different diameters d and different radii of curvature R after the vibration test are shown in TABLE 2. In TABLE 2, a value in parentheses indicates the number of spark plugs in which discharge through the insulator occurred out of 20 spark plugs.

TABLE 2

| Diameter d (mm) | Radius of curvature R (mm) 0.4 | 0.6 | 0.7 | 0.8 | 1.0 |
|---|---|---|---|---|---|
| 3.9 | A | A | A | A | A |
| 3.0 | A | A | B | B | B |
| 2.9 | A | A(1) | B(5) | B(5) | B |
| 2.7 | A | A(1) | B(8) | B(9) | B |

2. Evaluation of Withstand Voltage Using Insulators with Different Radii of Curvature r (Withstand Voltage Test after Vibration Test)

The withstand voltage test was performed after a vibration test. Specifically, impact was applied to the spark plugs "b" for 10 minutes with a stroke of 22 (mm) at a rate of 400 times per minute according to the "impact resistance test" described in section 7.4 of JIS B 8031 (2006), and then the withstand voltage test was performed.

The results of the withstand voltage test performed using different diameters d and different radii of curvature r after the vibration test are shown in TABLE 3.

TABLE 3

| Diameter d (mm) | Radius of curvature r (mm) 0.4 | 0.6 | 0.7 | 0.8 | 1.0 |
|---|---|---|---|---|---|
| 3.9 | A | A | A | B | B |
| 3.0 | A | A | A | B | B |
| 2.9 | A | A | B | B | B |

(Measurement of Rate of Occurrence of Chipping of Insulator)

In the process of producing the spark plugs "b," the number of spark plugs in which the insulator connecting surface chipped when the center electrode was inserted into the axial bore of the insulator was counted, and an evaluation was made according to the following criteria.

B: Of 200 spark plugs, two or more spark plugs suffered chipping of the insulator connecting surface.

A: Of 200 spark plugs, one spark plug suffered chipping of the insulator connecting surface or no spark plugs suffered chipping of the insulator connecting surface.

The evaluation results of the rate of occurrence of chipping performed using different diameters d and different radii of curvature r are shown in TABLE 4.

TABLE 4

| Diameter d (mm) | Radius of curvature r (mm) 0.05 | 0.1 | 0.2 | 0.3 | 0.4 | 0.5 | 0.6 |
|---|---|---|---|---|---|---|---|
| 3.9 | B | A | A | A | A | A | A |
| 3.0 | B | A | A | A | A | A | A |
| 2.9 | B | A | A | A | A | A | A |

3. Evaluation Using Different Relative Dielectric Constant Materials Disposed in Space F (Withstand Voltage Test)

A withstand voltage test was performed as in the above-described withstand voltage test except that the spark plugs "c" in which the materials disposed in the space F had different relative dielectric constants were used. The results are shown in TABLE 5.

TABLE 5

| | Relative dielectric constant 2 | 3 | 4 | 5 | 6 | 7 | 8 | 9 | 10 | 11 | 12 |
|---|---|---|---|---|---|---|---|---|---|---|---|
| Evaluation | B | A | A | A | A | A | A | A | A | B | B |

As shown in TABLE 1, the results of the withstand voltage test were good when the radius of curvature R of the seal portion was 0.1 (mm) or more. However, the results of the withstand voltage test were poor when the radius of curvature R was 0.05 (mm) or less.

As shown in TABLE 2, the results of the withstand voltage test performed after the vibration test were good when the diameter d was 3.0 (mm) or less and the radius of curvature R was 0.6 (mm) or less. In the evaluation results when the diameter d was 2.7 (mm), the difference between the number of spark plugs which had a radius of curvature R of 0.6 (mm) or less and in which through discharge had occurred and the number of spark plugs which had a radius of curvature R of more than 0.6 (mm) and in which through discharge had occurred was larger than that when the diameter d was 2.9 (mm). Therefore, it was found that the effect obtained by setting the radius of curvature R to be 0.6 mm or less becomes more remarkable in the case where the diameter d is 2.7 (mm).

As shown in TABLE 3, the results of the withstand voltage test performed after the vibration test were good when the radius of curvature r of the insulator was 0.6 (mm) or less. As shown in TABLE 4, the rate of occurrence of chipping of the insulator was low when the radius of curvature r was 0.1 (mm) or more.

As shown in TABLE 5, the results of the withstand voltage test were good when the relative dielectric constant of the material disposed in the space F was 3 or more and 10 or less.

DESCRIPTION OF REFERENCE NUMERALS

1: spark plug
2: center electrode
3: insulator
4: ground electrode
5: metallic shell
6: metal terminal
7: rod portion

8: head portion
9: axial bore
10: seal portion, lower seal portion
11: leg portion
12: trunk portion
13: flange portion
14: rear trunk portion
15: threaded portion
16: gas seal portion
17: gasket
18: tool engagement portion
19: crimp portion
20, 21: packing
22: talc
23: tubular portion
24: ledge portion
25: front tubular portion
26: exposed portion
27: columnar portion
28: upper seal portion
29: resistor
30: leg portion inner circumferential surface
31: trunk portion inner circumferential surface
32: support surface
33: seal portion outer circumferential surface
34: seal portion abutment surface
35: connecting surface
36: abutment surface
37: insulator connecting surface
41, 42: noble metal tip
43: inner member

The invention claimed is:

1. A spark plug comprising:

a center electrode including a rod portion extending in a direction of an axis and a head portion extending continuously from a rear end of the rod portion and having a diameter larger than a diameter of the rod portion;

an insulator having an axial bore, the center electrode being disposed in the axial bore at a front end thereof; and a seal portion for fixing the center electrode in the axial bore, wherein the insulator has a leg portion inner circumferential surface which surrounds the rod portion, a cylindrical trunk portion inner circumferential surface which has a diameter larger than a diameter of the leg portion inner circumferential surface, surrounds the head portion, and has a center axis coinciding with the axis, and a support surface which supports the head portion and extends continuously between the leg portion inner circumferential surface and the trunk portion inner circumferential surface, the seal portion has a seal portion outer circumferential surface in contact with the trunk portion inner circumferential surface, a seal portion abutment surface in contact with the support surface, and a connecting surface extending continuously between the seal portion outer circumferential surface and the seal portion abutment surface, and, in a cross section of the seal portion cut along a plane including the axis, a curve, which is part of a contour of the seal portion appearing in the cross-section and is included in the connecting surface, has a radius of curvature R of 0.1 mm or more.

2. The spark plug according to claim 1, wherein when a diameter d of the axial bore is 3 mm or less at a position at which the diameter of the head portion becomes maximum within a region surrounded by the trunk portion inner circumferential surface, the radius of curvature R is 0.6 mm or less.

3. The spark plug according to claim 1, wherein the insulator has an insulator connecting surface extending continuously between the support surface and the leg portion inner circumferential surface, and in a cross section of the insulator cut along a plane including the axis, a curve, which is part of a contour of the insulator appearing in the cross-section and is included in the insulator connecting surface, has a radius of curvature r of 0.6 mm or less.

4. The spark plug according to claim 2, wherein the diameter d is 2.7 mm or less.

5. The spark plug according to claim 2, wherein the insulator has an insulator connecting surface extending continuously between the support surface and the leg portion inner circumferential surface, and in a cross section of the insulator cut along a plane including the axis, a curve, which is part of a contour of the insulator appearing in the cross-section and is included in the insulator connecting surface, has a radius of curvature r of 0.6 mm or less.

* * * * *